US010704554B2

(12) United States Patent
Nakai et al.

(10) Patent No.: US 10,704,554 B2
(45) Date of Patent: Jul. 7, 2020

(54) CROSS-FLOW FAN

(71) Applicant: DAIKIN INDUSTRIES, LTD., Osaka-shi, Osaka (JP)

(72) Inventors: Satoshi Nakai, Osaka (JP); Nobuyasu Ichikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 120 days.

(21) Appl. No.: 15/770,741

(22) PCT Filed: Oct. 26, 2016

(86) PCT No.: PCT/JP2016/081683
§ 371 (c)(1),
(2) Date: Apr. 24, 2018

(87) PCT Pub. No.: WO2017/073593
PCT Pub. Date: May 4, 2017

(65) Prior Publication Data

US 2018/0328367 A1 Nov. 15, 2018

(30) Foreign Application Priority Data

Oct. 30, 2016 (JP) ..... 2015-215169

(51) Int. Cl.
*F04D 29/28* (2006.01)
*F04D 17/04* (2006.01)

(52) U.S. Cl.
CPC ..... *F04D 17/04* (2013.01); *F04D 29/283* (2013.01)

(58) Field of Classification Search
None
See application file for complete search history.

(56) References Cited

U.S. PATENT DOCUMENTS 3,385,511 A * 5/1968 Wentling ..... F04D 29/283 416/178
4,067,094 A * 1/1978 Ittner ..... B23P 15/006 239/265.29

(Continued)

FOREIGN PATENT DOCUMENTS

JP 2-102396 A 4/1990
JP 2002-257078 A 9/2002

(Continued)

OTHER PUBLICATIONS

International Search Report of corresponding PCT Application No. PCT/JP2016/081683 dated Jan. 24, 2017.

(Continued)

*Primary Examiner* — Michael Lebentritt
(74) *Attorney, Agent, or Firm* — Global IP Counselors, LLP

(57) ABSTRACT

A cross-flow fan made of resin includes first and second fan blocks joined together. The first fan block includes a first support plate, plural first blades connected to the first support plate, and a first outer peripheral ring having a first ring portion that interconnects outer ends of the plural first blades. The second fan block includes a second support plate, plural second blades having second one-side distal ends connected to the second support plate, and a second outer peripheral ring having a second ring portion that interconnects outer ends of the plural second blades adjacent second other-side distal ends of the plural second blades. The second other-side distal ends of the plural second blades are joined to the first support plate, and the first support plate and the second outer peripheral ring are disposed adjacent to each other.

24 Claims, 12 Drawing Sheets

(56) References Cited

U.S. PATENT DOCUMENTS

| | | | | |
|---|---|---|---|---|
| 6,179,566 | B1 * | 1/2001 | Andulics | B63H 1/20 416/178 |
| 6,761,040 | B2 * | 7/2004 | Ahn | F01D 5/14 416/203 |
| 7,220,101 | B2 * | 5/2007 | Chen | F01D 1/02 415/204 |
| 7,422,418 | B2 * | 9/2008 | Ishijima | F04D 29/283 415/119 |
| 9,995,316 | B2 * | 6/2018 | Hall | F04D 17/04 |
| 2015/0252816 | A1 * | 9/2015 | Nakai | F04D 29/283 416/178 |
| 2017/0002827 | A1 * | 1/2017 | Uda | F04D 17/04 |
| 2017/0051760 | A1 * | 2/2017 | Uda | F04D 17/04 |

FOREIGN PATENT DOCUMENTS

| | | | |
|---|---|---|---|
| JP | 2004-285937 | A | 10/2004 |
| JP | 2014-47772 | A | 3/2014 |
| JP | 2014-70518 | A | 4/2014 |
| WO | 2013/018359 | A1 | 7/2013 |

OTHER PUBLICATIONS

International Preliminary Report of corresponding PCT Application No. PCT/JP2015/081683 dated May 11, 2018.
European Search Report of corresponding EP Application No. 16 85 9823.3 dated Oct. 11, 2018.

* cited by examiner

CROSS-FLOW FAN

CROSS-REFERENCE TO RELATED APPLICATIONS

This U.S. National stage application claims priority under 35 U.S.C. § 119(a) to Japanese Patent Application No. 2015-215169, filed in Japan on Oct. 30, 2015, the entire contents of which are hereby incorporated herein by reference.

TECHNICAL FIELD

The present invention relates to a cross-flow fan and particularly a cross-flow fan equipped with blades made of resin.

BACKGROUND ART

Cross-flow fans used in indoor units of air conditioning systems, for example, have plural blades that extend in the longitudinal direction of the cross-flow fan and are disposed between annular partition plates disposed on both longitudinal direction ends of the cross-flow fan. Additionally, as disclosed in JP-A No. 2014-47772, for example, there are cases where a reinforcement ring is disposed between support plates to reinforce the strength of the plural blades.

SUMMARY

Technical Problem

The cross-flow fan disclosed in JP-A No. 2014-47772 has an auxiliary ring disposed in the longitudinal direction middle section of the blades, but with this configuration also, owing to an increase in the diameter of the fan blocks and a lengthening of the blade length to improve performance in recent years, there is a tendency for shifts to become greater in the positions of the distal ends of the blades of each fan block because of, for example, thermal contraction of the resin when molding the fan blocks. When positional shifts occur in the distal ends of the blades of the fan blocks in this way, not only does it become difficult to align the fan blocks when joining together the fan blocks by ultrasonic welding, for example, and require extra manufacturing time, but alignment of the distal ends of the blades must be forcibly performed, so it becomes easier for torsion to arise in the blades, resulting, for example, in the occurrence of noise and a reduction in blowing performance.

It is a problem of the present invention to provide a cross-flow fan that is inexpensive and has good performance.

Solution to Problem

A cross-flow fan pertaining to a first aspect of the invention is a cross-flow fan that is made of resin and includes a first fan block and a second fan block that are joined together, wherein the first fan block is equipped with a disc-shaped or annular first support plate, plural first blades having first one-side distal ends connected to the first support plate, and a first outer peripheral ring having a first ring portion that interconnects outer ends of the plural first blades in the neighborhood of first other-side distal ends of the plural first blades located on the opposite side of the first one-side distal ends, the second fan block is equipped with a disc-shaped or annular second support plate, plural second blades having second one-side distal ends connected to the second support plate, and a second outer peripheral ring having a second ring portion that interconnects outer ends of the plural second blades in the neighborhood of second other-side distal ends of the plural second blades located on the opposite side of the second one-side distal ends, the second other-side distal ends of the plural second blades are joined to the first support plate, and the first support plate and the second outer peripheral ring are disposed in close proximity to each other.

According to the cross-flow fan pertaining to the first aspect, because the second other-side distal ends of the plural second blades are joined to the first support plate, and the first support plate and the second outer peripheral ring are disposed in close proximity to each other, shifts in the positions of the second other-side distal ends of the plural second blades of the second fan block can be prevented by the second outer peripheral ring, so when aligning the plural second blades and the first support plate there is no longer the need to correct shifts in the positions of the plural second blades that have shifted positions.

A cross-flow fan pertaining to a second aspect of the invention is the cross-flow fan of the first aspect, wherein the first support plate, the plural first blades, and the first outer peripheral ring of the first fan block are integrally molded, and the second support plate, the plural second blades, and the second outer peripheral ring of the second fan block are integrally molded.

According to the cross-flow fan pertaining to the second aspect, because the first support plate, the plural first blades, and the first outer peripheral ring are integrally molded and the second support plate, the plural second blades, and the second outer peripheral ring are integrally molded, the first one-side distal ends of the plural first blades of the first fan block are fixed by the first support plate and the first other-side distal ends are fixed by the first outer peripheral ring, so that it becomes difficult for the first fan block to become deformed. Furthermore, the second one-side distal ends of the plural second blades of the second fan block are fixed by the second support plate and the second other-side distal ends are fixed by the second outer peripheral ring, so that it becomes difficult for the second fan block to become deformed. As a result, the dimensional accuracy of the first fan block and the second fan block when joining together the first fan block and the second fan block is improved.

A cross-flow fan pertaining to a third aspect of the invention is the cross-flow fan of the first aspect or the second aspect, wherein the second other-side distal ends of the plural second blades of the second fan block are positioned in a place where they project toward the opposite side of the second one-side distal ends from the second outer peripheral ring.

According to the cross-flow fan pertaining to the third aspect, because the second other-side distal ends of the plural second blades are positioned in a place where they project toward the opposite side of the second one-side distal ends from the second outer peripheral ring, it becomes possible to ensure that the second outer peripheral ring and first support plate are not joined together while joining together the second other-side distal ends of the plural second blades and the first support plate of the first fan block using ultrasonic welding, for example, the joining together of the first fan block and the second fan block can be performed strongly and inexpensively, and the occurrence of noise can be suppressed by not joining together the second outer peripheral ring and the first support plate.

A cross-flow fan pertaining to a fourth aspect of the invention is the cross-flow fan of any of the first aspect to the third aspect, wherein the first support plate has a down-step portion at which the section of the first support plate corresponding to the second outer peripheral ring is sunken below the section of the first support plate corresponding to the inner peripheral side of the second outer peripheral ring, and the second outer peripheral ring enters the down-step portion, thereby reducing the longitudinal direction thickness with which the first support plate and the second outer peripheral ring lie on top of each other.

According to the cross-flow fan pertaining to the fourth aspect, because the second outer peripheral ring enters the down-step portion of the first support plate, thereby reducing the longitudinal direction thickness with which the first support plate and the second outer peripheral ring lie on top of each other, workability can be improved while suppressing a worsening of air flow resistance caused by the first support plate and the second outer peripheral ring and stopping a worsening of power consumption.

A cross-flow fan pertaining to a fifth aspect of the invention is the cross-flow fan of the fourth aspect, wherein the down-step portion of the first support plate is sunken deeper than the longitudinal direction thickness of the second outer peripheral ring in the longitudinal direction.

According to the cross-flow fan pertaining to the fifth aspect, because the down-step portion of the first support plate is sunken deeper than the longitudinal direction thickness of the second outer peripheral ring in the longitudinal direction, the thickness of the section where the second outer peripheral ring and the first support plate lie on top of each other can be made thin up to the thickness of the first support plate, and a worsening of air flow resistance can be sufficiently suppressed.

A cross-flow fan pertaining to a sixth aspect of the invention is the cross-flow fan of either the fourth aspect or the fifth aspect, wherein the first support plate further has welding ribs that are welded to the second other-side distal ends of the plural second blades, and the welding ribs are formed in such a way as to extend to the down-step portion, with the height of sections of the welding ribs positioned in the down-step portion being lower than the height of sections of the welding ribs on the inner peripheral side of the down-step portion.

According to the cross-flow fan pertaining to the sixth aspect, because the welding ribs are formed in such a way as to extend to the down-step portion, with the height of the sections of the welding ribs positioned in the down-step portion being lower than the height of the sections of the welding ribs on the inner peripheral side of the down-step portion, projection of welding burrs into the down-step portion can be suppressed while strongly connecting the first support plate and the plural second blades to each other by ultrasonic welding.

A cross-flow fan pertaining to a seventh aspect of the invention is the cross-flow fan of any of the first aspect to the sixth aspect, wherein the second outer peripheral ring has an outer radius that is the same as or smaller than an outer radius of the first support plate.

According to the cross-flow fan pertaining to the seventh aspect, because the second outer peripheral ring has the outer radius that is the same as or smaller than the outer radius of the first support plate, in comparison to a case where the outer radius of the second outer peripheral ring is larger than that of the first support plate, the risk of contact with a casing that covers the outer portion of the cross-flow fan, for example, can be suppressed.

A cross-flow fan pertaining to an eighth aspect of the invention is the cross-flow fan of any of the first aspect to the seventh aspect, wherein the second outer peripheral ring further has reinforcement ribs that are connected to negative pressure surfaces of the plural second blades but are not connected to pressure surfaces of the plural second blades.

According to the cross-flow fan pertaining to the eighth aspect, because the second outer peripheral ring has the reinforcement ribs that are connected to the negative pressure surfaces of the plural second blades but are not connected to the pressure surfaces of the plural second blades, the ability to withstand external force applied to the second blades can be enhanced.

A cross-flow fan pertaining to a ninth aspect of the invention is the cross-flow fan of any of the fourth aspect to the sixth aspect, wherein the first support plate further has thinned portions provided in such a way as not to not reach the down-step portion.

According to the cross-flow fan pertaining to the ninth aspect, because the first support plate has the thinned portions provided in such a way as not to reach the down-step portion, the cross-flow fan can be made lighter while maintaining its strength, and the second blades can be strongly connected to the first support plate by ultrasonic welding, for example.

Advantageous Effects of Invention

In the cross-flow fan pertaining to the first aspect of the invention, a cross-flow fan that is inexpensive, because time and effort when manufacturing the cross-flow fan are saved, can be provided, and a cross-flow fan that has good performance, because a reduction in the performance of the cross-flow fan caused by shifts in the positions of the second other-side distal ends of the second blades is suppressed, can be provided.

In the cross-flow fan pertaining to the second aspect of the invention, the accuracy of the alignment between the first fan block and the second fan block can be improved.

In the cross-flow fan pertaining to the third aspect of the invention, it becomes easy to provide a cross-flow fan that is strong and inexpensive, has good performance, and in which there is little noise.

In the cross-flow fan pertaining to the fourth aspect of the invention, high performance can be realized inexpensively.

In the cross-flow fan pertaining to the fifth aspect of the invention, a cross-flow fan that is inexpensive and has a sufficiently high performance can be provided.

In the cross-flow fan pertaining to the sixth aspect of the invention, a reduction in the performance of the cross-flow fan caused by welding burrs can be prevented.

In the cross-flow fan pertaining to the seventh aspect of the invention, the risk of deformation of and damage to the second outer peripheral ring can be suppressed.

In the cross-flow fan pertaining to the eighth aspect of the invention, a cross-flow fan that is inexpensive and sturdy can be provided.

In the cross-flow fan pertaining to the ninth aspect of the invention, a cross-flow fan that is sturdy and light can be inexpensively provided.

DESCRIPTION OF EMBODIMENT

A cross-flow fan pertaining to an embodiment of the invention will be described below using, as an example, a cross-flow fan installed in an indoor unit of an air conditioning system.

(1) Cross-Flow Fan Inside Indoor Unit

Figure 1:
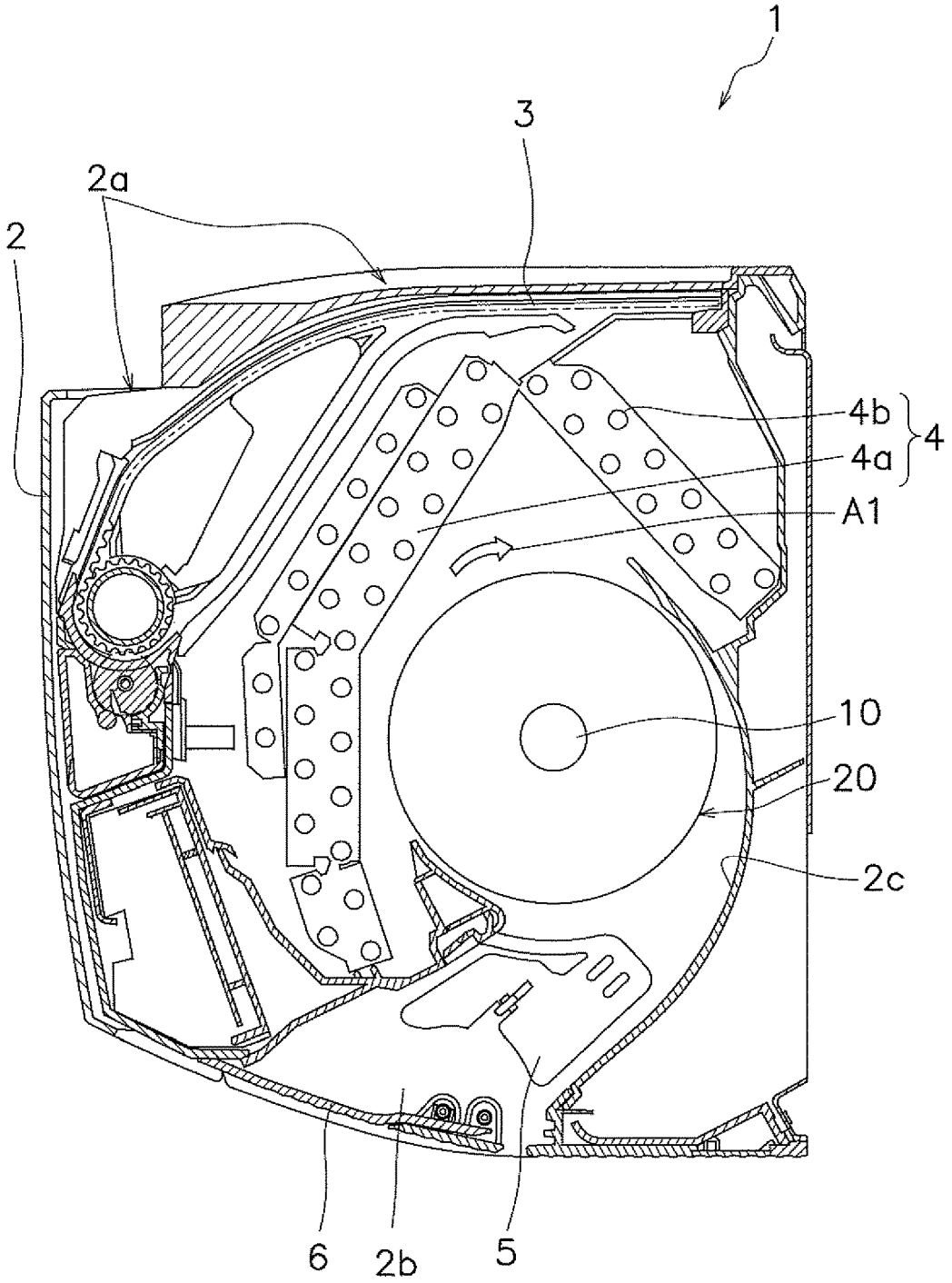
FIG. 1 is a cross-sectional view showing a general overview of an indoor unit of an air conditioning system.

FIG. 1 is a drawing showing a general overview of a cross section of an indoor unit 1 of an air conditioning system. The indoor unit 1 is equipped with a body casing 2, an air filter 3, an indoor heat exchanger 4, a cross-flow fan 10, vertical flaps 5, and a horizontal flap 6. As shown in FIG. 1, the air filter 3 is disposed on the downstream side of, and opposing, an air inlet 2*a* in the top surface of the body casing 2. The indoor heat exchanger 4 is disposed further downstream of the air filter 3. Room air that travels through the air inlet 2*a* and reaches the indoor heat exchanger 4 all travels through the air filter 3 and has dirt and dust removed therefrom.

The indoor heat exchanger 4 is configured by a front-side heat exchanger 4*a* and a back-side heat exchanger 4*b* that are coupled to each other so as to form an inverted V-shape as seen in a side view. In a plan view seen from the top surface of the body casing 2, the front-side heat exchanger 4*a* is disposed in a position opposing the substantially front half of the air inlet 2*a*, and the back-side heat exchanger 4*b* is disposed in a position opposing the substantially back half of the air inlet 2*a*. Both the front-side heat exchanger 4*a* and the back-side heat exchanger 4*b* are configured by lining up numerous plate fins parallel to the width direction of the indoor unit 1 and attaching them to heat transfer tubes. When the room air that has been sucked in from the air inlet 2*a* and has traveled through the air filter 3 passes between the plate fins of the front-side heat exchanger 4*a* and the back-side heat exchanger 4*b*, heat exchange takes place and air conditioning is performed.

On the downstream side of the indoor heat exchanger 4, the cross-flow fan 10, which is shaped substantially like an open cylinder, extends longly along the width direction of the body casing 2 and, together with the indoor heat exchanger 4, is provided parallel to the width direction of the body casing 2. The cross-flow fan 10 is equipped with an impeller 20, which is disposed in a space surrounded in such a way as to be sandwiched by the inverted V-shaped indoor heat exchanger 4, and a fan motor (not shown in the drawings), which is for driving the impeller 20. The cross-flow fan 10 generates an airflow by rotating the impeller 20 in direction A1 (a clockwise direction) indicated by the arrow in FIG. 1.

An outgoing air passage leading to an air outlet 2*b* downstream of the impeller 20 of the cross-flow fan 10 has a back surface side configured by a scroll member 2*c*. The scroll member 2*c* has a width that is substantially the same as that of the open portion of the air outlet 2*b* in the body casing 2 as seen in a front view. The upper end of the scroll member 2*c* is positioned higher than the upper end of the impeller 20 and, as seen in a side view, is positioned in a place offset more toward the back surface side than a central axis of the open cylinder-shaped impeller 20. The lower end of the scroll member 2*c* is coupled to the open end of the air outlet 2*b*. A guide surface of the scroll member 2*c* exhibits a smoothly curved shape having a center of curvature on the side of the cross-flow fan 10 as seen in a cross-sectional view in order to smoothly and quietly guide to the air outlet 2*b* the air blown out from the impeller 20.

(2) General Structure of Impeller of Cross-Flow Fan

Figure 2:
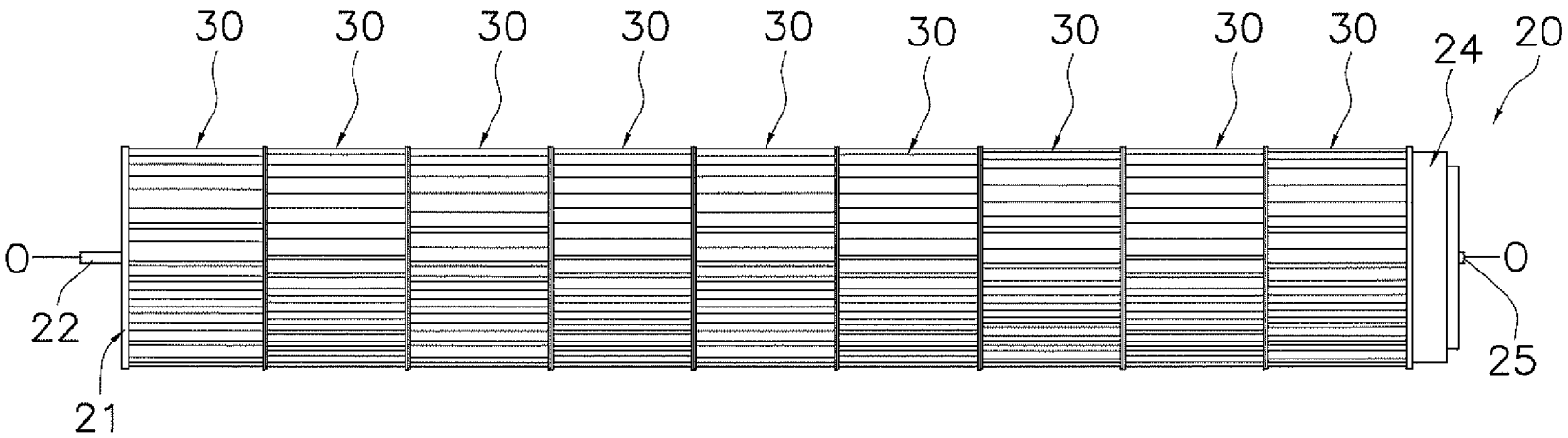
FIG. 2 is a front view showing a general overview of an impeller of a cross-flow fan pertaining to an embodiment.

In FIG. 2 is shown the general structure of the impeller 20 of the cross-flow fan 10. The impeller 20 is, for example, configured to include two end plates 21 and 24 and nine fan blocks 30. The end plate 21 is disposed on one end of the impeller 20 and has, on a central axis O, a rotating shaft 22 made of metal. Additionally, normally a boss portion 25 connected to a fan motor shaft (not shown in the drawings) is provided in the central portion of the end plate 24 disposed on the other end of the impeller 20 and to which blades 40 and an outer peripheral ring 60 are attached. Alternatively, there are also cases where the end plate 24 disposed on the other end of the impeller 20 has another configuration, such as one where the end plate 24 is configured to have a member linked to part of the fan motor and to have a metal shaft in its central portion. The rotating shaft 22 of the end plate 21 and the boss portion 25 of the end plate 24 on the other end of the impeller 20 are supported, and the impeller 20 rotates about the central axis O.

Figure 3:
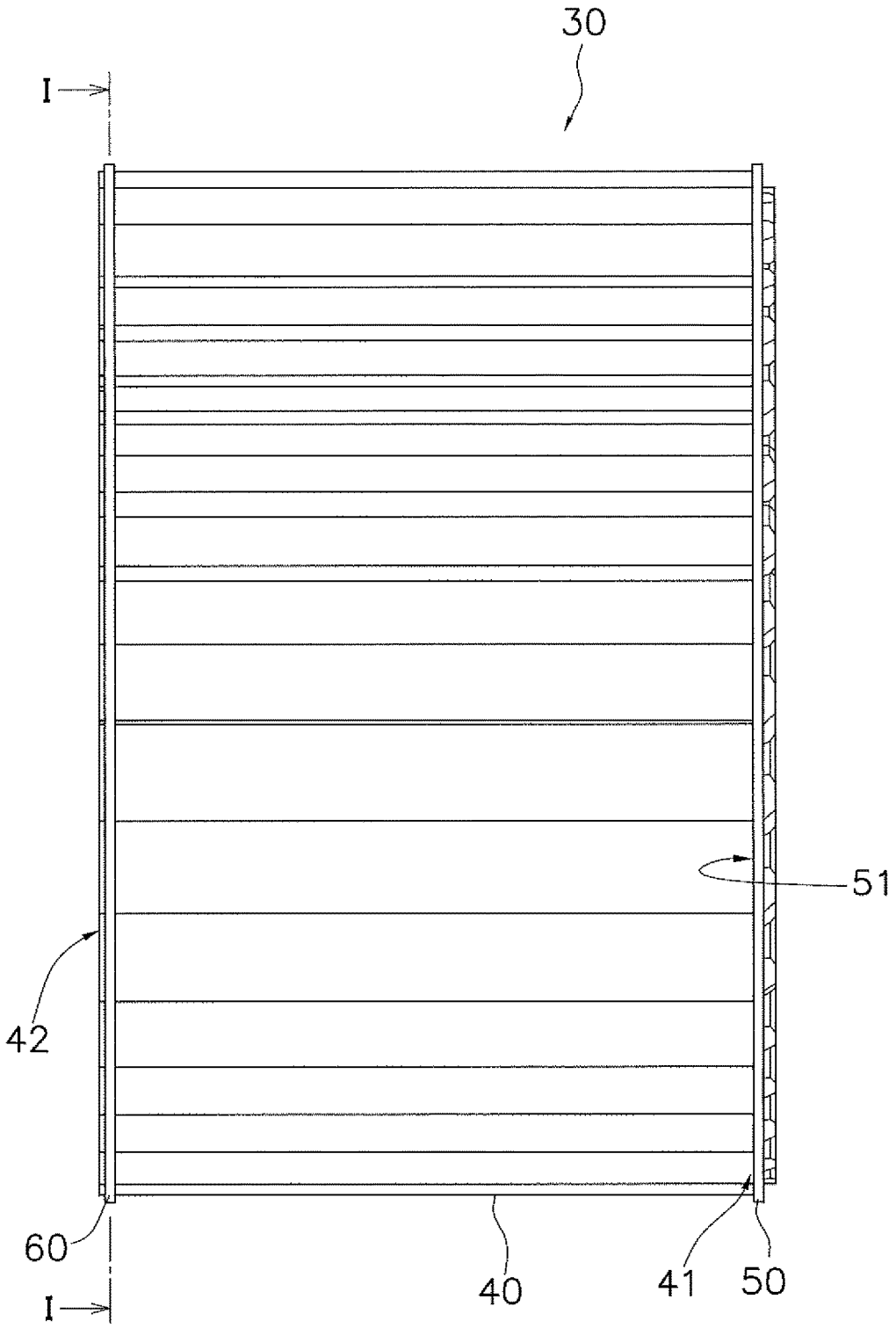
FIG. 3 is a front view showing an example of the configuration of a fan block of the impeller.

As shown in FIG. 3, each fan block 30 is equipped with plural blades 40, an annular support plate 50, and an outer peripheral ring 60. In assembling the impeller 20, each fan block 30 has its own plural blades 40 welded to the support plate 50 of the adjacent fan block 30 or the end plate 21. One-side distal ends 41 of the blades 40 are connected to the support plate 50, and other-side distal ends 42 of the blades 40 become welded.

Figure 4:
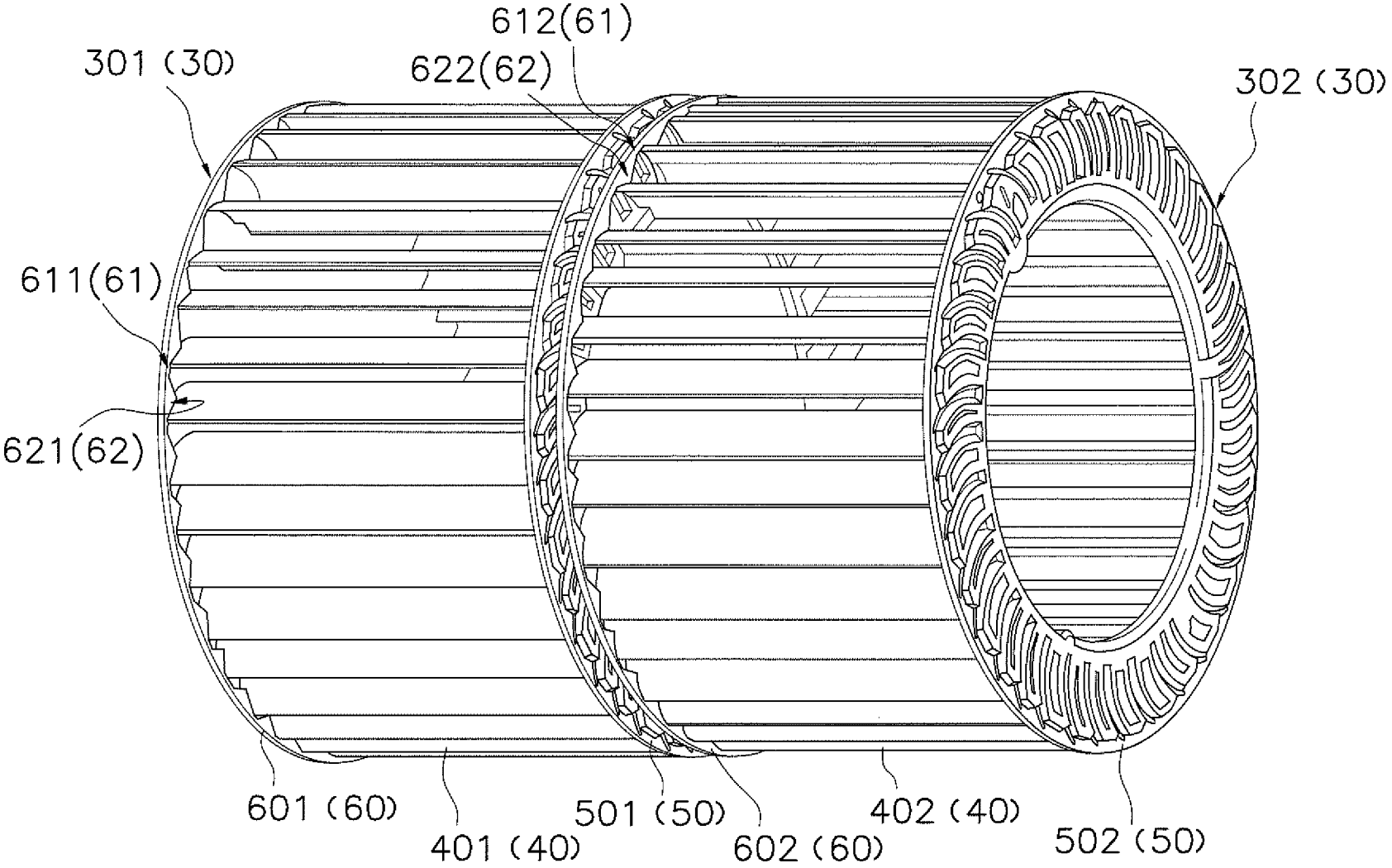
FIG. 4 is a perspective view for describing a process in assembling the impeller of the cross-flow fan.
Figure 5:
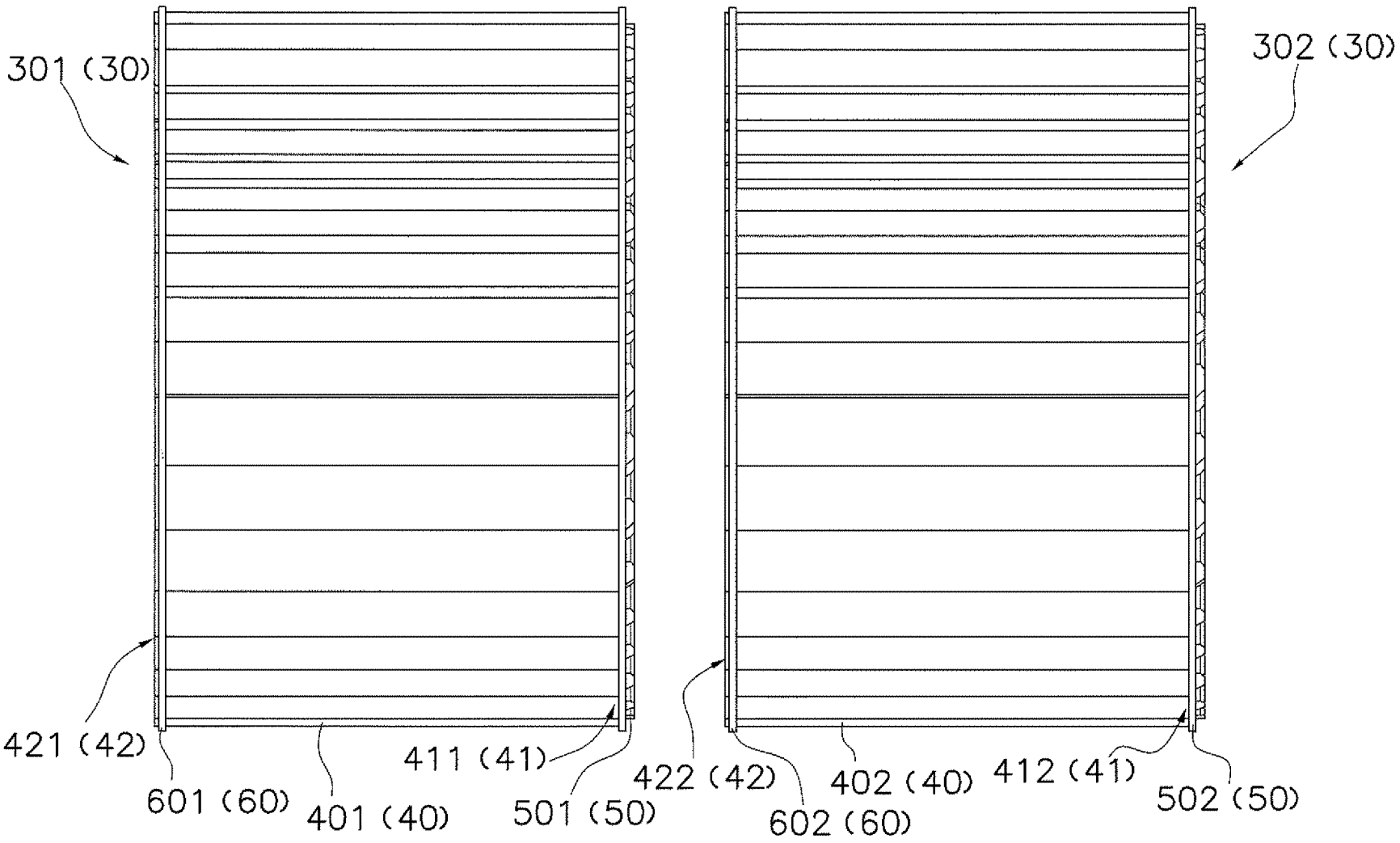
FIG. 5 is a front view for describing a process in assembling the impeller of the cross-flow fan.

In FIG. 4 and FIG. 5 are shown two fan blocks that are disposed adjacent to each other and become welded to each other. In FIG. 4 and FIG. 5, one fan block 30 will be called a first fan block 301 and the other fan block 30 will be called a second fan block 302. Furthermore, the support plate 50 of the first fan block 301 will be called a first support plate 501, the blades 40 of the first fan block 301 will be called first blades 401, and the outer peripheral ring 60 of the first fan block 301 will be called a first outer peripheral ring 601. Moreover, the support plate 50 of the second fan block 302 will be called a second support plate 502, the blades 40 of the second fan block 302 will be called second blades 402, and the outer peripheral ring 60 of the second fan block 302 will be called a second outer peripheral ring 602. Furthermore, a ring portion 61 that the first outer peripheral ring 601 has will be called a first ring portion 611 and reinforcement ribs 62 that the first outer peripheral ring 601 has will be called first reinforcement ribs 621, and a ring portion 61 that the second outer peripheral ring 602 has will be called a second ring portion 612 and reinforcement ribs 62 that the second outer peripheral ring 602 has will be called second reinforcement ribs 622. It will be noted that the one-side distal ends 41 of the first blades 401 are first one-side distal ends 411 and that the other-side distal ends 42 of the first blades 401 are first other-side distal ends 421. Furthermore, the one-side distal ends 41 of the second blades 402 are second one-side distal ends 412 and the other-side distal ends 42 of the second blades 402 are second other-side distal ends 422.

When the first fan block 301 and the second fan block 302 shown in FIG. 4 and FIG. 5 are joined together, the first support plate 501 of the first fan block 301 and the second other-side distal ends 422 of the plural second blades 402 of the second fan block 302 are welded together by ultrasonic waves. Namely, the two fan blocks 30 adjacent to each other can be viewed in such a way that the second fan block 302 is the one having the other-side distal ends 42 of the blades 40 that become welded and the first fan block 301 is the one having the support plate 50 that becomes welded.

(3) Detailed Configuration of Fan Blocks

Figure 6:
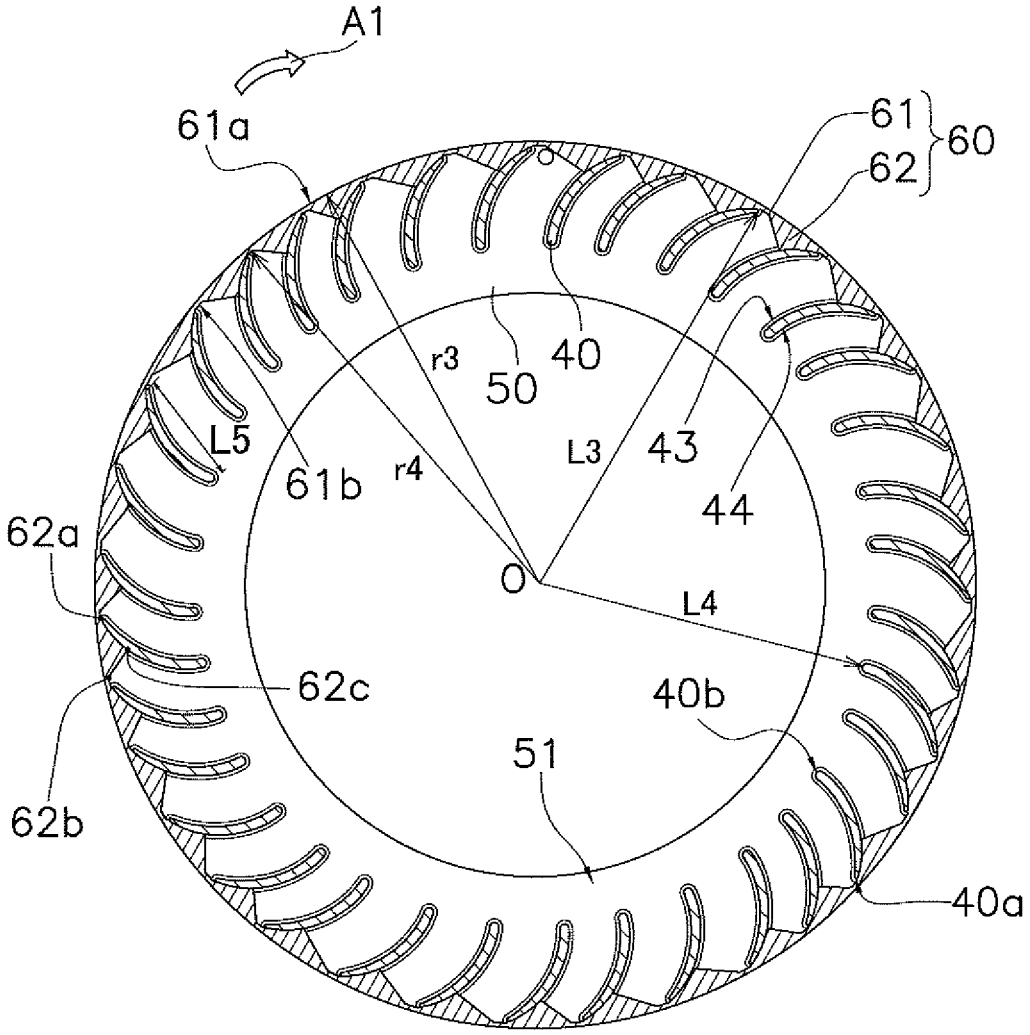
FIG. 6 is a cross-sectional view, cut along line I-I of FIG. 3, for describing an example configuration of an auxiliary ring of the fan block.

The fan blocks 30 pertaining to the present embodiment each comprise the plural blades 40, the support plate 50, and the outer peripheral ring 60, which are integrally molded by injection molding, for example, using a thermoplastic resin as the main material. In FIG. 6 is shown a cross section where the fan block 30 is cut by line I-I of FIG. 3. Namely, the cross section shown in FIG. 6 is a cross section that appears when the fan block 30 is cut by a plane perpendicular to the central axis O. The rotational direction of the fan block 30 is direction A1 indicated by the arrow in FIG. 6.

(3-1) Blades

The plural blades 40 extend in the longitudinal direction (the direction along the central axis O) from a first surface 51 of the annular support plate 50. Both outer ends 40*a* and inner ends 40*b* of the blades 40 shown in FIG. 6 form edges parallel to the central axis O. The one-side distal ends 41 of the blades 40 are fixed to the first surface 51 of the support plate 50 as a result of the blades 40 being molded integrally with the support plate 50 (see FIG. 3). The other-side distal ends 42 are on the opposite side of the one-side distal ends 41 of the blades 40 in the longitudinal direction of the blades 40.

The blades 40 each have a negative pressure surface 43 and a pressure surface 44. As shown in FIG. 6, both the negative pressure surfaces 43 and the pressure surfaces 44 curve in the same direction, so the cross section of each blade 40 as cut by a plane perpendicular to the central axis O is shaped like a crescent moon. When the fan block 30 rotates in direction A1 indicated by the arrow in FIG. 6, the pressure on the pressure surface 44 sides of the blades 40 becomes higher while the pressure on the negative pressure surface 43 sides becomes lower. The number of blades 40 disposed in each fan block 30 is thirty-five. If the blades 40 were disposed so as to have rotational symmetry, the angle formed by two mutually adjacent straight lines out of the thirty-five straight lines joining the outer ends 40*a* of the blades 40 to the central axis O in a plane perpendicular to the central axis O, for example, would be about 10.3 degrees. However, in each fan block 30, the angle formed by these is set to vary from about 8 degrees to about 12 degrees. Namely, this means that the plural blades 40 are disposed so as to have rotational asymmetry. In this way, by disposing the plural blades 40 in a shape that does not have rotational symmetry, compared to disposing the plural blades 40 so as to have rotational symmetry with respect to the central axis O, the inclination of the blades 40 in the direction in which the blades 40 detach from a split mold—which is a mold for molding the fan block 30—is changed and it is easier to remove the fan block 30.

Among the plural blades 40 is one blade 40 having a cutout portion (not shown in the drawings) formed in its other-side distal end 42. The cutout portion is for positioning the first support plate 501 of the first fan block 301 and the plural second blades 402 of the second fan block 302. Because the cutout portion is there, it becomes easy to position the plural second blades 402, which are disposed so as to have rotational asymmetry as described above, and the first support plate 501.

(3-2) Support Plate

Figure 7:
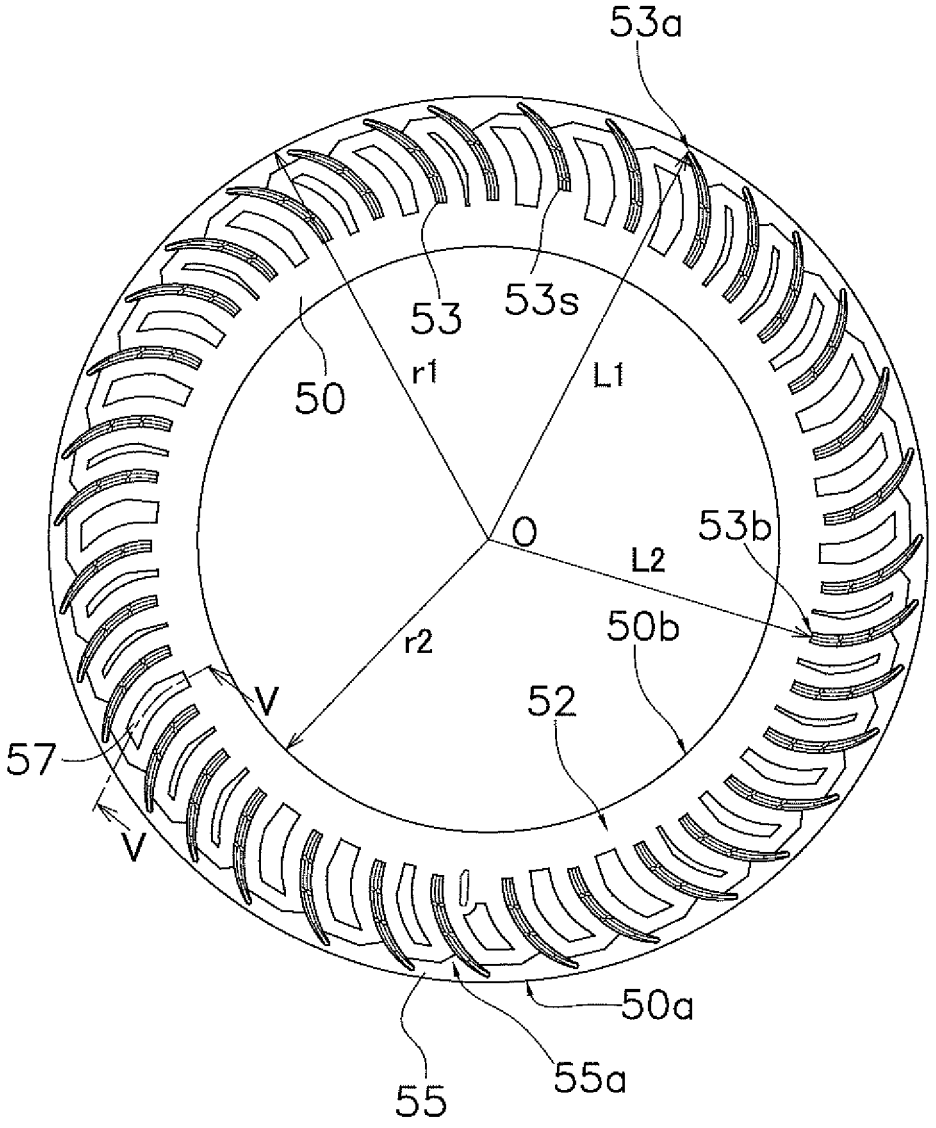
FIG. 7 is a plan view for describing an example configuration of a support plate of the fan block.
Figure 8:
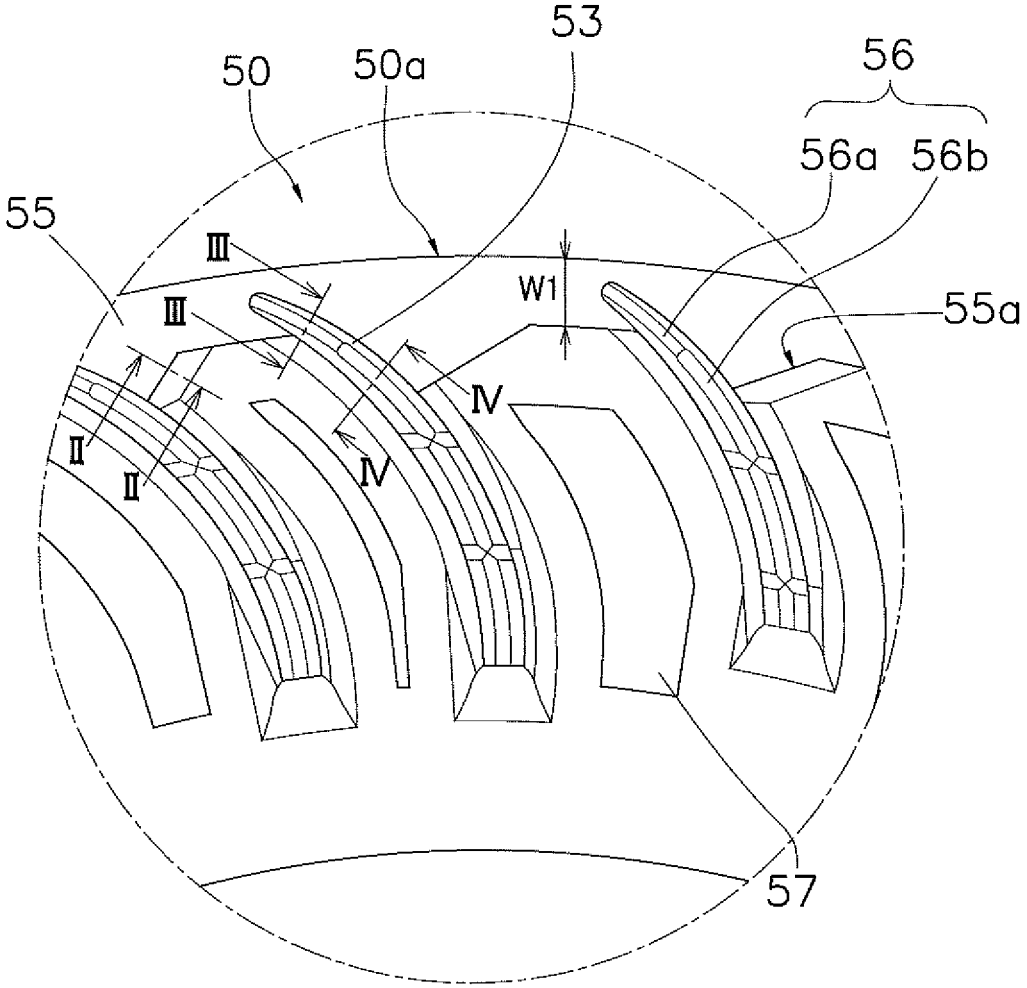
FIG. 8 is an enlarged plan view showing an enlargement of part of the support plate of FIG. 7.

In FIG. 7 is shown a state in which the annular support plate 50 is seen from the side of a second surface 52 located on the opposite side of the first surface 51. Furthermore, in FIG. 8 is shown an enlargement of part of FIG. 7. The second surface 52 of the support plate 50 is not flat. In the second surface 52 of the support plate 50, recess portions 53, into which the other-side distal ends 42 of the blades 40 fit, are formed in the same number as the plural blades 40. The recess portions 53 each have a planar shape that is slightly larger than the cross-sectional shape of the blades 40, so when two fan blocks 30 are laid on top of each other, the blades 40 fit into the recess portions 53.

Figure 9:
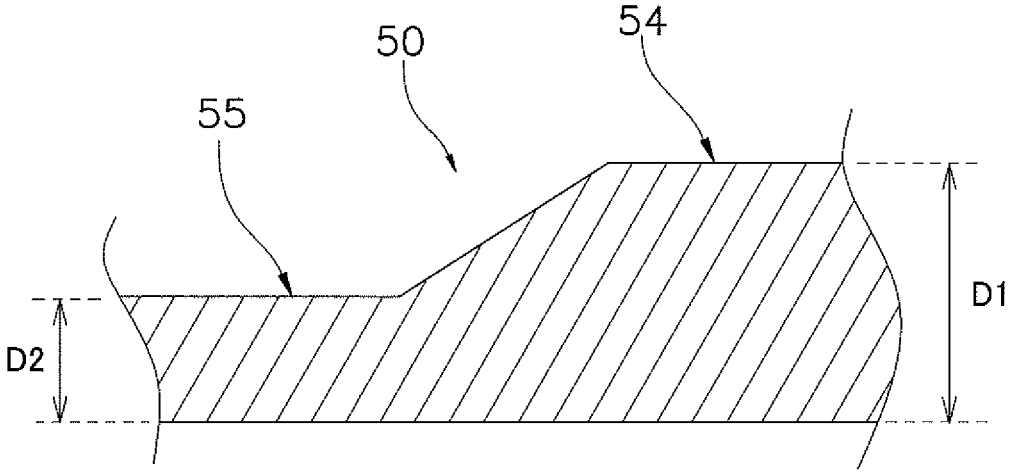
FIG. 9 is an enlarged cross-sectional view where the support plate is cut along line II-II of FIG. 8.

In the second surface 52 of the support plate 50, a down-step portion 55 is formed along an outer periphery 50*a* of the support plate 50. A cross section along line II-II of FIG. 8 is shown in FIG. 9. A thickness D2 of the down-step portion 55 is thinner than a thickness D1 of the section of a principal plane 54 occupying most of the second surface 52. For example, whereas the thickness D1 is about 2.5 mm, the thickness D2 is about 1 mm. Furthermore, for example, in the support plate 50 where a radius r1 of the outer periphery 50*a* is about 50 mm, a width W1 of the down-step portion 55 is set to about 2 mm to about 3 mm from the outer periphery 50*a*. It will be noted that a radius r2 of an inner periphery 50*b* of the support plate 50 is about 40 mm, for example.

Figure 10:
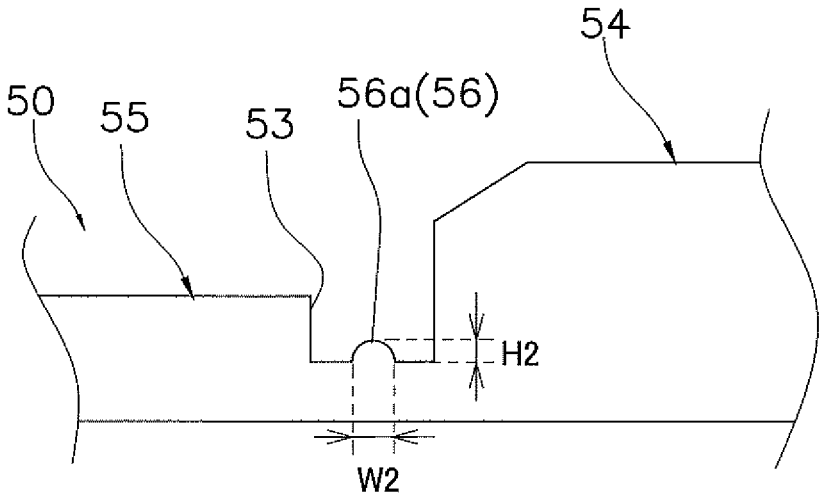
FIG. 10 is an enlarged cross-sectional view where the support plate is cut along line III-III of FIG. 8.
Figure 11:
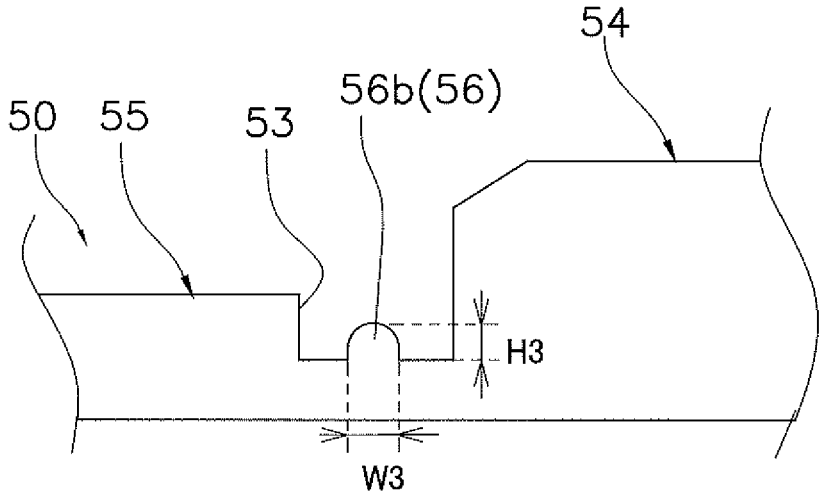
FIG. 11 is an enlarged cross-sectional view where the support plate is cut along line IV-IV of FIG. 8.

A cross section along line of FIG. 8 is shown in FIG. 10. Furthermore, a cross section along line IV-IV of FIG. 8 is shown in FIG. 11. Welding ribs 56 shown in FIG. 10 and FIG. 11 are formed within the recess portions 53 of the second surface 52. The welding ribs 56 are formed in such a way that a height H2 of outer peripheral sections 56*a* that are in the range of the width W1 of the down-step portion 55 is lower than a height H3 of inner peripheral sections 56*b* located on the inner periphery 50*b* side of the width W1 of the down-step portion 55. Furthermore, a width W2 of the outer peripheral sections 56*a* of the welding ribs 56 is formed smaller than a width W3 of the inner peripheral sections 56*b*. The welding ribs 56 are sections that melt, become integrated with the other-side distal ends 42 of the blades 40, and solidify when the support plate 50 and the blades 40 are welded together. The inner peripheral sections 56*b* of the welding ribs 56 are set in such a way that a high welding strength is obtained by setting their height H3 and width W3 larger to thereby increase the volume of the welding ribs 56. At the same time, by setting the height H2 of the outer peripheral sections 56*a* of the welding ribs 56 lower in comparison to the height H3 of the inner peripheral sections 56*b*, welding burrs made of melted parts of the welding ribs 56 can be suppressed from sticking out between the support plate 50 and the outer peripheral ring 60. Moreover, by setting the width W2 of the outer peripheral sections 56*a* of the welding ribs 56 smaller in comparison to the width W3 of the inner peripheral sections 56*b*, the volume per unit length of the welding ribs 56 becomes smaller, so the effect of suppressing welding burrs made of melted parts of the welding ribs 56 from sticking out between the support plate 50 and the outer peripheral ring 60 is further enhanced.

Outer ends 53*a* of the recess portions 53 of the support plate 50 are located on the inner side of the outer periphery 50*a* of the support plate 50. Consequently, a distance L1 from the center of the support plate 50 (a point on the central axis O) to the outer ends 53*a* of the recess portions 53 is smaller than the radius r1 of the outer periphery 50*a* but is the same as or slightly larger than a distance L3 from the central axis O to the outer ends 40*a* of the blades 40. Inner ends 53*b* of the recess portions 53 of the support plate 50 are located on the outer side of the inner periphery 50*b* of the support plate 50. Consequently, a distance L2 from the center of the support plate 50 to the inner ends 53*b* of the recess portions 53 is larger than the radius r2 of the inner periphery 50*b* but is slightly smaller than a distance L4 from the central axis O to the inner ends 40*b* of the blades 40. In this way, because the radius r1 of the outer periphery 50*a* of the support plate 50 is set larger than the distance L3 between the outer ends 40*a* of the blades 40 and the central axis O, and the radius r2 of the inner periphery 50*b* of the support plate 50 is set smaller than the distance L4 between the inner ends 40*b* of the blades 40 and the central axis O, the strength with which the support plate 50 supports the blades 40 becomes greater.

Figure 12:
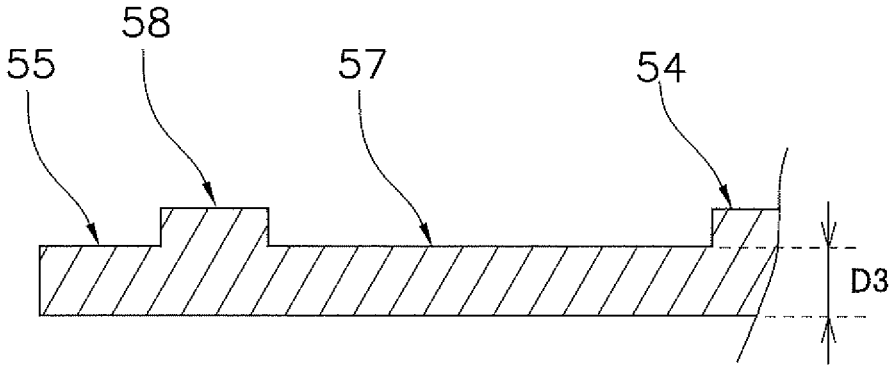
FIG. 12 is an enlarged cross-sectional view cut along line V-V of FIG. 7.

In the principal plane 54 of the support plate 50, thinned portions 57 are formed between adjacent recess portions 53. In FIG. 12 is shown a cross section of the support plate 50 along line V-V of FIG. 7. A thickness D3 of the thinned portions 57 is, for example, about 1 mm thinner than the thickness D1 of the principal plane 54. In this way, because the thickness D3 of the thinned portions 57 is thinner than the thickness D1 of the principal plane 54, the material resin can be reduced and the weight of the fan blocks 30 is reduced. However, because the down-step portion 55 is formed in the support plate 50, if the thinned portions 57 and the down-step portion 55 were to connect to each other, this would lead to a reduction in the strength of the support plate 50. Therefore, outer walls 58 are formed on the outer peripheral sides of the thinned portions 57 to ensure that the thinned portions 57 and the down-step portion 55 do not connect to each other. Because the outer walls 58 are formed, an ultrasonic welding horn can be brought into contact with the inner radial side neighborhood of the down-step portion 55, and up to the outer ends 40*a* of the blades 40 can be sufficiently welded.

(3-3) Outer Peripheral Ring

In FIG. 6 is shown the cross-sectional shape of the section where the outer peripheral ring 60 and the blades 40 are joined together. The outer peripheral ring 60 is equipped with the ring portion 61 and the reinforcement ribs 62. A radius r3 of an outer periphery 61*a* of the ring portion 61 is set the same as the radius r1 of the outer periphery 50*a* of the support plate 50. Furthermore, the radius r3 of the outer periphery 61*a* of the ring portion 61 is larger than the distance L3 from the central axis O of the outer peripheral ring 60 to the outer ends 40*a* of the blades 40. That is, the outer periphery 61*a* of the ring portion 61 runs along the outer side of the outer ends 40*a* of all the blades 40. Furthermore, a radius r4 of an inner periphery 61*b* of the ring portion 61 of the outer peripheral ring 60 is greater than the radius r2 of the inner periphery 50*b* of the support plate 50 and slightly greater than the distance L3 to the outer ends 40*a* of the blades 40, and the inner periphery 61*b* of the ring portion 61 runs along the neighborhood of the outer side of the outer ends 40*a* of the blades 40.

As shown in FIG. 6, the reinforcement ribs 62 each have a triangular cross-sectional shape that projects inward from the ring portion 61. The triangular reinforcement ribs 62 each have three vertex portions 62*a*, 62*b*, and 62*c*; the sides between the vertex portions 62*a* and 62*b* are connected to the ring portion 61, and the sides between the vertex portions 62*a* and 62*c* are connected to the negative pressure surfaces 43 of the blades 40. At the same time, the reinforcement ribs 62 are not connected to the pressure surfaces 44 of the blades 40. The length of the sections where the reinforcement ribs 62 are connected to the negative pressure surfaces 43 (the length between the vertex portions 62*a* and the vertex portions 62*c*) is shorter than ½ of a chord length L5. Here, the chord length L5 is the length from the outer ends 40*a* to the inner ends 40*b* of the blades 40. By setting the length of the sections connected to the negative pressure surfaces 43 shorter than ½ of the chord length L5, blowing characteristics are improved in comparison to a case where the length of the sections connected to the negative pressure surfaces 43 is set longer than ½ of the chord length L5. Moreover, it is preferred that the length of the sections of the reinforcement ribs 62 connected to the negative pressure surfaces 43 be shorter than ⅓ of the chord length L5 in order to improve blowing characteristics.

Figure 13:
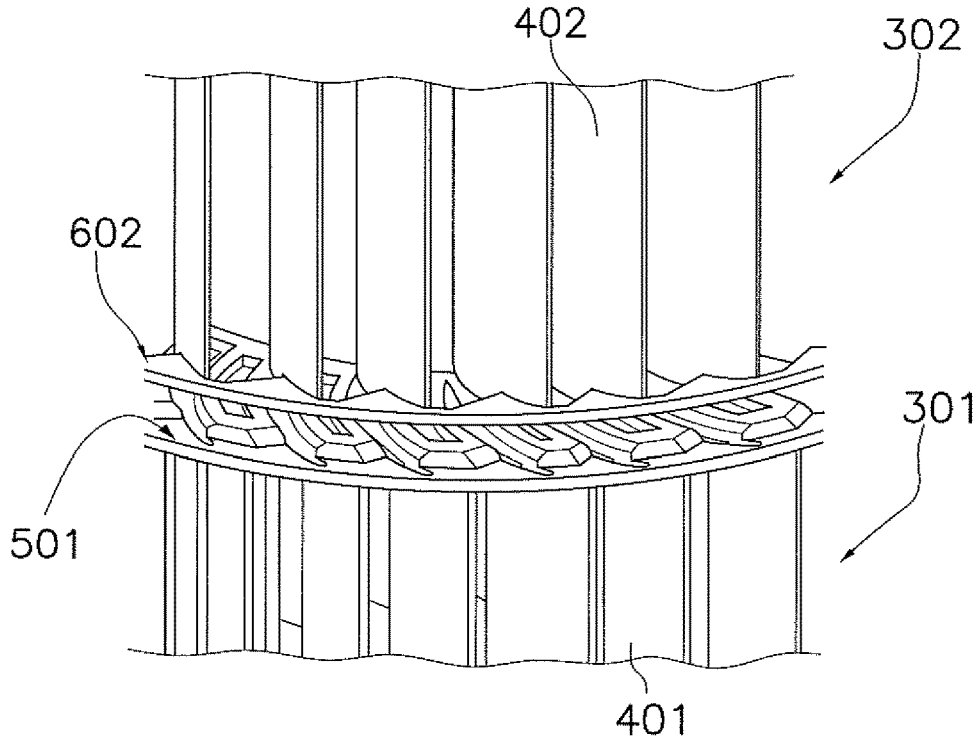
FIG. 13 is a perspective view for describing a way of assembling a first fan block and a second fan block that become joined together.
Figure 14:
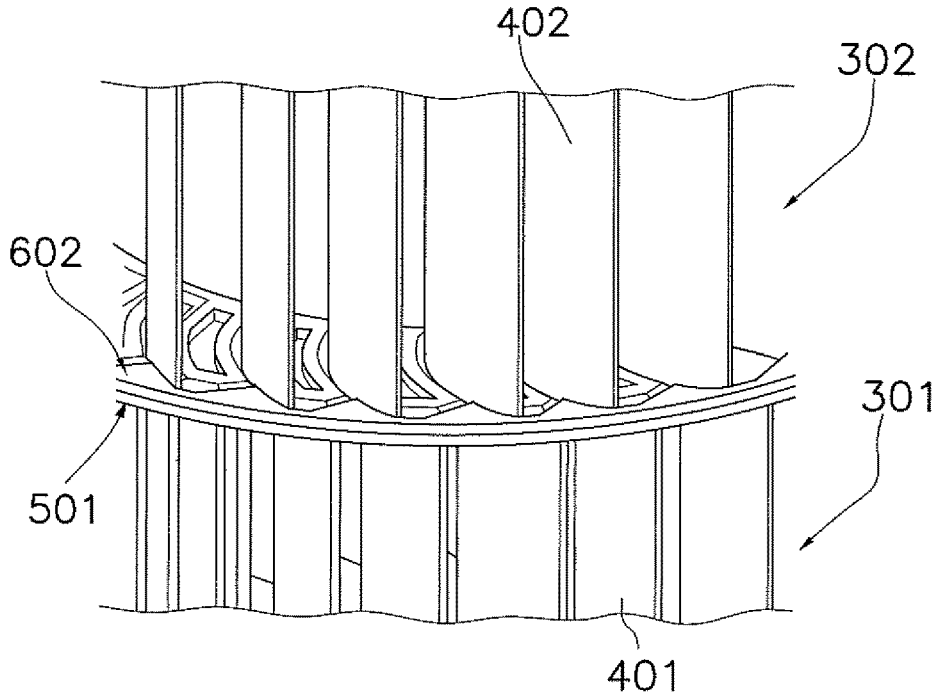
FIG. 14 is a perspective view for describing a way of assembling the first fan block and the second fan block that become joined together.
Figure 15:
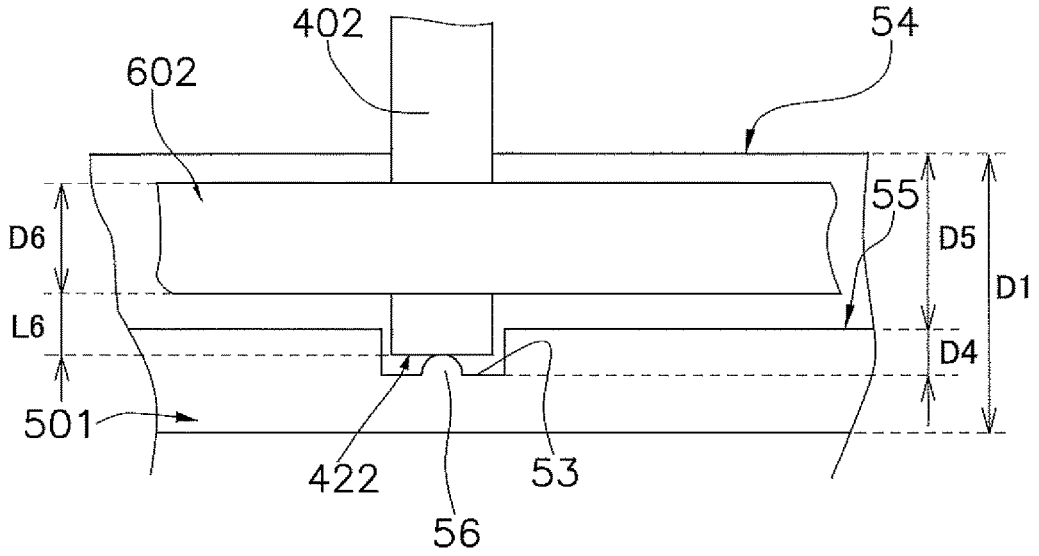
FIG. 15 is a schematic partial enlarged view for describing the structure in the vicinity of a first support plate of the first fan block and a second outer peripheral ring of the second fan block.

In FIG. 13 and FIG. 14 is shown a state in which the first fan block 301 and the second fan block 302 become joined together. In FIG. 15 is schematically shown an enlargement of the structure in the vicinity of the first support plate 501 of the first fan block 301 and the second outer peripheral ring 602 of the second fan block 302. The second outer peripheral ring 602 is provided in the neighborhood of the second other-side distal ends 422 of the second blades 402. More specifically, the second other-side distal ends 422 of the second blades 402 project toward the opposite side of the second one-side distal ends 412 from the second outer peripheral ring 602. A length L6 to which the second other-side distal ends 422 project is longer than a thickness D4 from the bottom surfaces of the recess portions 53 of the first support plate 501 to the upper surface of the down-step portion 55. Because of this structure, even when the second other-side distal ends 422 of the second blades 402 of the second fan block 302 are welded by ultrasonic welding to the bottom surfaces of the recess portions 53 of the first support plate 501, the second outer peripheral ring 602 and the first support plate 501 come into close proximity to each other but do not contact each other. Here, the second outer peripheral ring 602 and the first support plate 501 are in close proximity to each other such that the gap between them is smaller than 1 mm. Furthermore, it is preferred that the second outer peripheral ring 602 and the first support plate 501 be in close proximity to each other such that the gap between them is smaller than 0.5 mm. When ultrasonically welded, the welding ribs 56 in FIG. 15 melt and become integrated with the second outer peripheral ring 602 and the first support plate 501.

Furthermore, a depth D5 from the principal plane 54 of the first support plate 501 to the upper surface of the down-step portion 55 is larger than a thickness D6 of the second outer peripheral ring 602. In other words, this means that, in the longitudinal direction of the cross-flow fan 10, the down-step portion 55 is sunken deeper than the thickness D6 of the second outer peripheral ring 602. Because of this structure, even when the second outer peripheral ring 602 is provided, in the longitudinal direction of the cross-flow fan 10, the second outer peripheral ring 602 and the first support plate 501 fall in the range of the thickness D1 of the first support plate 501.

In order for the second outer peripheral ring 602 to fit the confines of the recess portions 53 of the first support plate 501, the width (r3-r4) of the second ring portion 612 of the second outer peripheral ring 602 is set smaller than the width W1 of the down-step portion 55. Furthermore, in order for the triangular second reinforcement ribs 62 of the second outer peripheral ring 602 to fit within the down-step portion 55, widened portions 55*a* corresponding to the triangular shapes of the second reinforcement ribs 622 are formed in the down-step portion 55. The width of the widened portions 55*a* is larger than the width W1.

Figure 16:
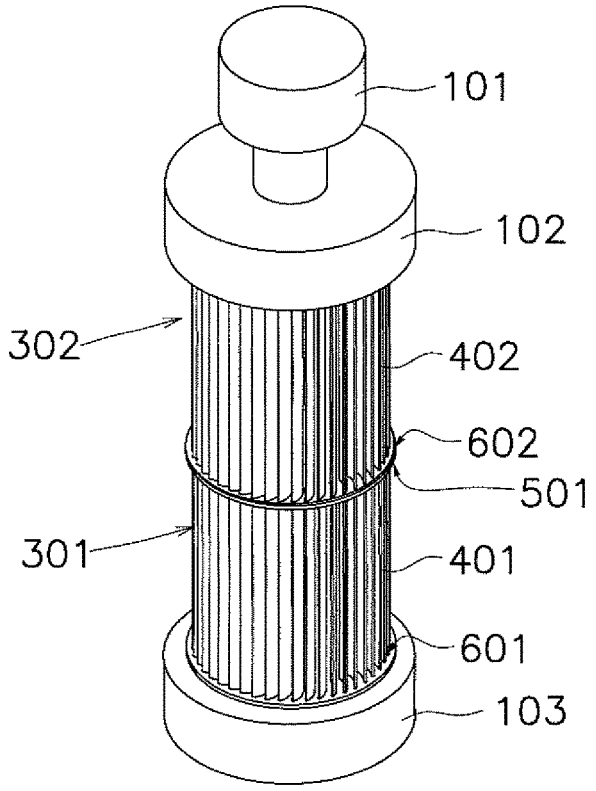
FIG. 16 is a perspective view for describing ultrasonic welding of the first fan block and the second fan block.

As shown in FIG. 13 and FIG. 14, the first fan block 301 and the second fan block 302 that have not yet been joined together are stacked on top of each other and installed on top of a jig 103 (see FIG. 16). The first fan block 301 and the second fan block 302 that have been stacked on top of each other are sandwiched between the jig 103 and an ultrasonic welding horn 102, and the first fan block 301 is supported from its periphery and fixed (not shown in the drawings). Ultrasonic waves are supplied from a transducer 101 to the ultrasonic welding horn 102, and the supplied ultrasonic waves travel through the ultrasonic welding horn 102 and become applied to the second fan block 302. Because of this, the second blades 402 of the second fan block 302 and the first support plate 501 of the first fan block 301 become welded to each other by the ultrasonic waves. Because the recess portions 53 of the first support plate 501 of the first fan block 301 each have a planar shape that is slightly larger than the cross-sectional shape of the corresponding second blades 402 as has already been described, the second blades 402 fit into and become mated with the recess portions 53. Among the recess portions 53 is formed one recess portion 53*s* whose length is largely different from others. Positioning becomes easier by virtue of this recess portion 53*s* and the corresponding second blade 402 being formed.

Figure 17A:
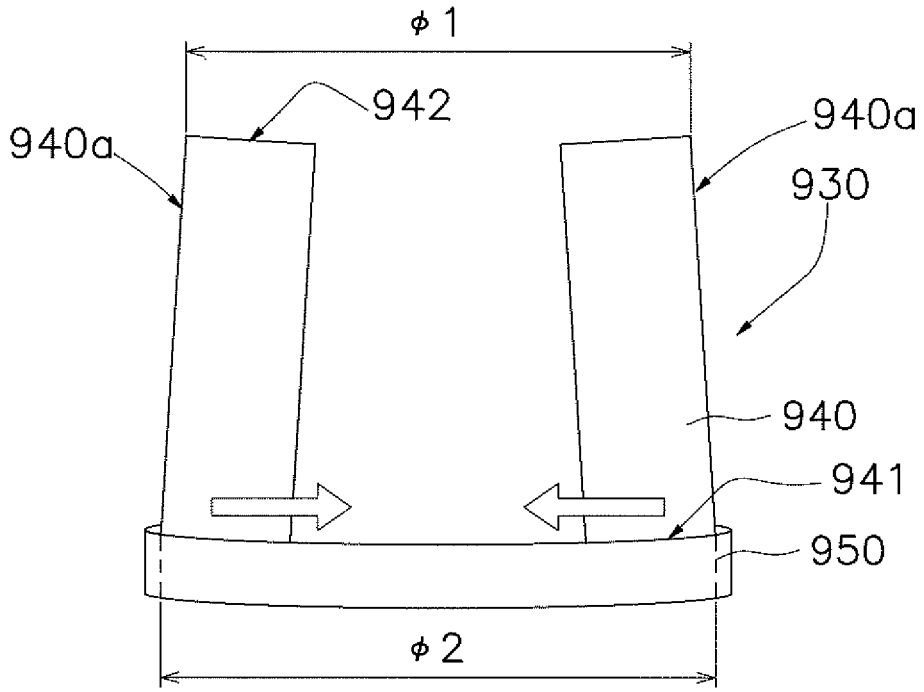
FIG. 17A is a schematic drawing for describing strain in the structure of a conventional fan block.

As shown in FIG. 17A, in a conventional fan block 930, there has not been an outer peripheral ring in the neighborhood of other-side distal ends 942 of blades 940, so when the plural blades 940 and a support plate 950 have been integrally molded by injection molding, sink marks arise and stress in the directions indicated by the arrows occurs starting after the injection of the resin in the injection molding. Because of this stress, a diameter φ1 of a circumference on which outer ends 940*a* of the blades 940 in the neighborhood of the other-side distal ends 942 are disposed becomes smaller with respect to a diameter φ2 of a circumference on which the outer ends 940*a* of the blades 940 in the neighborhood of one-side distal ends 941 of the blades 940 are disposed. Because the diameter φ1 becomes smaller, for example, there has arisen the need to align the blades 940 using a jig or to align the blades 940 by manual labor. When it has become necessary to align the blades 940 using a jig or to align the blades 940 by manual labor, it has been difficult to align the fan block 930 using a robot arm, for example, and it has been difficult to automate using a robot arm. Furthermore, in order to reduce as much as possible deformation of the resin during the injection molding, the fan block must be sufficiently cooled and then removed, and the amount of time for one shot of injection molding has become longer.

Figure 17B:
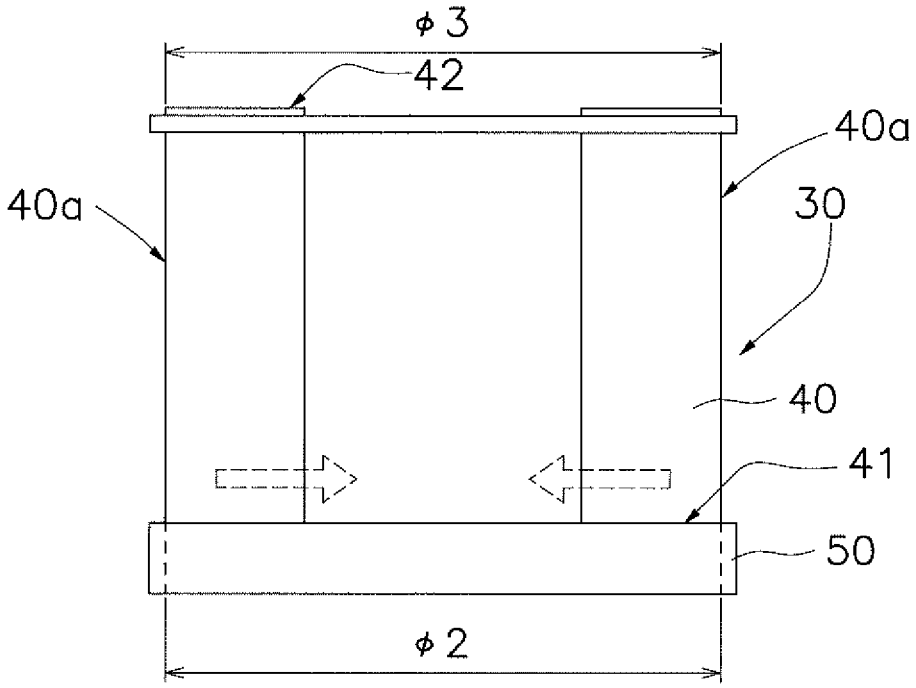
FIG. 17B is a schematic drawing for describing the elimination of strain in the fan block shown in FIG. 3.

As shown in FIG. 17B, in the above described fan block 30, the outer peripheral ring 60 is provided in the neighborhood of the other-side distal ends 42 of the blades 40, so when the plural blades 40 and the support plate 50 have been integrally molded by injection molding, the same sink marks arise and the same stress occurs in the directions of the arrows. However, the outer peripheral ring 60 works with respect to this stress to prevent deformation of the fan block 30, and deformation of the fan block 30 is suppressed. Because of the working of the outer peripheral ring 60, a diameter φ3 of a circumference on which the outer ends 40*a* of the blades 40 in the neighborhood of the other-side distal ends 42 are disposed can be prevented from becoming smaller with respect to the diameter φ2 of the circumference on which the outer ends 40*a* of the blades 40 in the neighborhood of the one-side distal ends 41 of the blades 40 are disposed. As a result, a robot arm, for example, can be used to align the first fan block 301 and the second fan block 302, so that the joining together of the first fan block 301 and the second fan block 302 can be automated. Furthermore, the amount of cooling time during the injection molding can be shortened, and the amount of time for one shot during the injection molding can be remarkably shortened in comparison to the fan block 930 shown in FIG. 17A.

(4) Example Modifications (4-1)

In the above embodiment, a case was described where the radius r3 of the outer periphery 61*a* of the ring portion 61 was the same as the radius r1 of the outer periphery 50*a* of the annular support plate 50, but the radius r3 of the outer periphery 61*a* of the ring portion 61 may also be set smaller than the radius r1 of the outer periphery 50*a* of the support plate 50.

(4-2)

In the above embodiment, a case was described where the radius r4 of the inner periphery 61*b* of the ring portion 61 was slightly larger than the distance L3 from the central axis O to the outer ends 40*a* of the blades 40, but the radius r4 may also be configured to be equal to the distance L3 so that the inner periphery 61*b* of the ring portion 61 is tangential to the outer ends 40*a* of the blades 40.

(4-3)

In the above embodiment, a case was described where the shape of the outer peripheral ring 60 was annular, but the shape of the outer peripheral ring 60 is not limited to being annular and, for example, may also be a polygonal shape having the same number of angles as the number of blades 40, and may also be a shape having serrations (numerous notches) made in its outer peripheral end.

(5) Characteristics (5-1)

As described above, in the cross-flow fan 10, the second other-side distal ends 422 of the plural second blades 402 of the second fan block 302 are joined to the first support plate 501 of the first fan block 301 by ultrasonic welding, and the first support plate 501 and the second outer peripheral ring 602 are disposed in close proximity to each other. Because the cross-flow fan 10 is configured in this way, shifts in the positions of the second other-side distal ends 422 of the plural second blades 402 of the second fan block 302 can be prevented by the second outer peripheral ring 602, so when aligning the plural second blades 402 and the first support plate 501 there is no longer the need to correct shifts in the positions of the plural second blades 402. In this way, the cross-flow fan 10 that is inexpensive, because time and effort when manufacturing the cross-flow fan 10 are saved, can be provided, and the cross-flow fan 10 that has good performance, because a reduction in the performance of the cross-flow fan 10 caused by shifts in the positions of the second other-side distal ends 422 of the second blades 402 of the second fan block 302 is suppressed, can be provided.

It will be noted that although in the above embodiment a case was described where the first support plate 501 and the second support plate 502 were annular, even if the first support plate 501 and the second support plate 502 are disc-shaped, they can be formed in the same way as in the case where they are annular, and even in the case of using disc-shaped support plates, the same effects as in the case of using the annular first support plate 501 and second support plate 502 are achieved.

(5-2)

In the cross-flow fan 10, the first support plate 501, the plural first blades 401, and the first outer peripheral ring 601 are integrally molded by injection molding. Likewise, the second support plate 502, the plural second blades 402, and the second outer peripheral ring 602 are integrally molded by injection molding. Because of this integral molding, the first one-side distal ends 411 of the plural first blades 401 of the first fan block 301 are fixed by the first support plate 501 and the first other-side distal ends 421 are fixed by the first outer peripheral ring 601, so that it becomes difficult for the first fan block 301 to become deformed. Furthermore, the second one-side distal ends 412 of the plural second blades 402 of the second fan block 302 are fixed by the second support plate 502 and the second other-side distal ends 422 are fixed by the second outer peripheral ring 602, so that it becomes difficult for the second fan block 302 to become deformed. As a result, the dimensional accuracy of the first fan block 301 and the second fan block 302 when joining together the first fan block 301 and the second fan block 302 is improved. As a result, the accuracy of the alignment between the first fan block 301 and the second fan block 302 can be improved. For example, when handling the first fan block 301 and the second fan block 302 with robot arms or suction pads, even when stress acts from the robot arms or the suction pads on these, deformation of the first fan block 301 and the second fan block 302 can be suppressed, so automation can be easily carried out because of the improvement in alignment accuracy.

(5-3)

Because the second other-side distal ends 422 of the plural second blades 402 are positioned in a place where they project toward the opposite side of the second one-side distal ends 412 from the second outer peripheral ring 602, it becomes possible to ensure that the second outer peripheral ring 602 and the first support plate 501 are not joined together while joining together the second other-side distal ends 422 of the plural second blades 402 and the first support plate 501 of the first fan block 301 using ultrasonic welding, for example. As a result, the joining together of the first fan block 301 and the second fan block 302 can be performed strongly and inexpensively, the occurrence of noise can be suppressed by not joining together the second outer peripheral ring 602 and the first support plate 501, and the cross-flow fan 10 that is inexpensive, has good performance, and in which there is little noise can be provided.

(5-4)

The second outer peripheral ring 602 enters the down-step portion 55 of the first support plate 501, thereby reducing the longitudinal direction thickness in which the first support plate 501 and the second outer peripheral ring 602 lie on top of each other. As a result, workability can be improved while suppressing a worsening of air flow resistance caused by the first support plate 501 and the second outer peripheral ring 602 and stopping a worsening of power consumption, and at the same time high performance can be realized inexpensively.

(5-5)

Because the down-step portion 55 of the first support plate 501 is sunken deeper than the longitudinal direction thickness D6 of the second outer peripheral ring 602 in the longitudinal direction, the thickness of the section where the second outer peripheral ring 602 and the first support plate 501 lie on top of each other can be made thin up to the thickness D1 of the first support plate 501. As a result, a worsening of air flow resistance can be sufficiently suppressed, so the cross-flow fan 10 that is inexpensive and has a sufficiently high performance can be provided.

(5-6)

Furthermore, in the cross-flow fan 10, the welding ribs 56 are formed in such a way as to extend to the down-step portion 55, with the height H2 of the outer peripheral sections 56*a* positioned in the down-step portion 55 being formed lower than the height H3 of the inner peripheral sections 56*b* located on the inner peripheral side of the down-step portion 55. Because the welding ribs 56 have this structure, projection of welding burrs into the down-step portion 55 can be suppressed while strongly connecting the first support plate 501 and the plural second blades 402 to each other by ultrasonic welding, and a reduction in the performance of the cross-flow fan 10 caused by welding burrs that have entered between the first support plate 501 and the second outer peripheral ring 602 and so forth can be prevented.

(5-7)

Because the second outer peripheral ring 602 of the cross-flow fan 10 has the radius r3 of the outer periphery 61*a* (the outer radius of the second outer peripheral ring 602) that is the same as or smaller than the radius r1 of the outer periphery 50*a* of the first support plate 501 (the outer radius of the first support plate 501), in comparison to a case where the outer radius of the second outer peripheral ring 602 is larger than that of the first support plate 501, the risk of contact with a casing that covers the outer portion of the cross-flow fan 10, for example, can be suppressed, and the risk of deformation of and damage to the second outer peripheral ring 602 can be suppressed.

(5-8)

Because the second outer peripheral ring 602 has the second reinforcement ribs 622 which are reinforcement ribs that are connected to the negative pressure surfaces 43 of the plural second blades 402 but are not connected to the pressure surfaces 44 of the plural second blades 402, the ability to withstand external force applied to the second blades 402 can be enhanced. As a result, a cross-flow fan that is inexpensive, sturdy, and includes the first fan block 301 and the second fan block 302 suited to manufacturing automation, for example, can be provided.

(5-9)

Because the first support plate 501 has the thinned portions 57 provided in such a way as not to reach the down-step portion 55, the cross-flow fan 10 can be made lighter while maintaining its strength, and the second blades 402 can be strongly connected to the first support plate 501 by ultrasonic welding, for example. As a result, the cross-flow fan 10 that is sturdy and light can be inexpensively provided.

REFERENCE SIGNS LIST

10 Cross-flow Fan
20 Impeller
30 Fan Block
40 Blades
50 Support Plate
55 Down-step Portion
56 Welding Ribs
57 Thinned Portions
60 Outer Peripheral Ring
61 Ring Portion
62 Reinforcement Ribs
301 First Fan Block
302 Second Fan Block
401 First Blades
402 Second Blades
411 First One-side Distal Ends
412 Second One-side Distal Ends
421 First Other-side Distal Ends
422 Second Other-side Distal Ends
501 First Support Plate
502 Second Support Plate
601 First Outer Peripheral Ring
602 Second Outer Peripheral Ring
611 First Ring Portion
612 Second Ring Portion
621 First Reinforcement Ribs
622 Second Reinforcement Ribs

CITATION LIST

Patent Literature

Patent Document 1: JP-A No. 2014-47772

What is claimed is:

1. A cross-flow fan that is made of resin, the cross-flow fan comprising:

a first fan block including
- a disc-shaped or annular first support plate,
- plural first blades having first one-side distal ends connected to the first support plate, and
- a first outer peripheral ring having a first ring portion that interconnects outer ends of the plural first blades adjacent first other-side distal ends of the plural first blades located on an opposite side of the first one-side distal ends; and a second fan block including
- a disc-shaped or annular second support plate,
- plural second blades having second one-side distal ends connected to the second support plate, and
- a second outer peripheral ring having a second ring portion that interconnects outer ends of the plural second blades adjacent second other-side distal ends of the plural second blades located on an opposite side of the second one-side distal ends, the first fan block and the second fan block being joined together, the second other-side distal ends of the plural second blades being joined to the first support plate, and the first support plate and the second outer peripheral ring being disposed adjacent to each other such that the second outer peripheral ring is not adjacent the first support plate in a radial direction of the cross-flow fan.

2. The cross-flow fan according to claim 1, wherein the first support plate, the plural first blades, and the first outer peripheral ring of the first fan block are integrally molded, and the second support plate, the plural second blades, and the second outer peripheral ring of the second fan block are integrally molded.

3. The cross-flow fan according to claim 1, wherein the second other-side distal ends of the plural second blades of the second fan block project toward the opposite side of the second one-side distal ends from the second outer peripheral ring.

4. The cross-flow fan according to claim 1, wherein the first support plate has a down-step portion, and a section of the first support plate corresponding to the second outer peripheral ring is sunken below a section of the first support plate corresponding to an inner peripheral side of the second outer peripheral ring at the down-step portion, and the second outer peripheral ring enters the down-step portion, reducing a longitudinal direction thickness where the first support plate and the second outer peripheral ring lie on top of each other.

5. A cross-flow fan that is made of resin, the cross-flow fan comprising:

a first fan block including
- a disc-shaped or annular first support plate,
- plural first blades having first one-side distal ends connected to the first support plate, and
- a first outer peripheral ring having a first ring portion that interconnects outer ends of the plural first blades adjacent first other-side distal ends of the plural first blades located on an opposite side of the first one-side distal ends; and a second fan block including
- a disc-shaped or annular second support plate,
- plural second blades having second one-side distal ends connected to the second support plate, and
- a second outer peripheral ring having a second ring portion that interconnects outer ends of the plural second blades adjacent second other-side distal ends of the plural second blades located on an opposite side of the second one-side distal ends, the first fan block and the second fan block being joined together, the second other-side distal ends of the plural second blades being Joined to the first support plate, and the first support plate and the second outer peripheral ring being disposed adjacent to each other, the first support plate having a down-step portion, and a section of the first support plate corresponding to the second outer peripheral ring being sunken below a section of the first support plate corresponding to an inner peripheral side of the second outer peripheral ring at the down-step portion, and the second outer peripheral ring entering the down-step portion, reducing a longitudinal direction thickness where the first support plate and the second outer peripheral ring lie on top of each other, and the down-step portion of the first support plate being sunken deeper than the longitudinal direction thickness of the second outer peripheral ring in the longitudinal direction.

6. The cross-flow fan according to claim 4, wherein
the first support plate further has welding ribs welded to the second other-side distal ends of the plural second blades, and
the welding ribs extend to the down-step portion, with a height of sections of the welding ribs positioned in the down-step portion being lower than a height of sections of the welding ribs on an inner peripheral side of the down-step portion.

7. The cross-flow fan according to claim 1, wherein
the second outer peripheral ring has an outer radius equal to or smaller than an outer radius of the first support plate.

8. The cross-flow fan according to claim 1, wherein
the second outer peripheral ring further has reinforcement ribs connected to negative pressure surfaces of the plural second blades but not connected to pressure surfaces of the plural second blades.

9. The cross-flow fan according to claim 1, wherein
the first support plate further has thinned portions that do not reach the down-step portion.

10. The cross-flow fan according to claim 2, wherein
the second other-side distal ends of the plural second blades of the second fan block project toward the opposite side of the second one-side distal ends from the second outer peripheral ring.

11. The cross-flow fan according to claim 2, wherein
the first support plate has a down-step portion, and a section of the first support plate corresponding to the second outer peripheral ring is sunken below a section of the first support plate corresponding to an inner peripheral side of the second outer peripheral ring at the down-step portion, and
the second outer peripheral ring enters the down-step portion, reducing a longitudinal direction thickness where the first support plate and the second outer peripheral ring lie on top of each other.

12. The cross-flow fan according to claim 2, wherein
the second outer peripheral ring has an outer radius equal to or smaller than an outer radius of the first support plate.

13. The cross-flow fan according to claim 2, wherein
the second outer peripheral ring further has reinforcement ribs connected to negative pressure surfaces of the plural second blades but not connected to pressure surfaces of the plural second blades.

14. The cross-flow fan according to claim 3, wherein
the first support plate has a down-step portion, and a section of the first support plate corresponding to the second outer peripheral ring is sunken below a section of the first support plate corresponding to an inner peripheral side of the second outer peripheral ring at the down-step portion, and
the second outer peripheral ring enters the down-step portion, reducing a longitudinal direction thickness where the first support plate and the second outer peripheral ring lie on top of each other.

15. The cross-flow fan according to claim 3, wherein
the second outer peripheral ring has an outer radius equal to or smaller than an outer radius of the first support plate.

16. The cross-flow fan according to claim 3, wherein
the second outer peripheral ring further has reinforcement ribs connected to negative pressure surfaces of the plural second blades but not connected to pressure surfaces of the plural second blades.

17. The cross-flow fan according to claim 4, wherein
the second outer peripheral ring has an outer radius equal to or smaller than an outer radius of the first support plate.

18. The cross-flow fan according to claim 4, wherein
the second outer peripheral ring further has reinforcement ribs connected to negative pressure surfaces of the plural second blades but not connected to pressure surfaces of the plural second blades.

19. The cross-flow fan according to claim 5, wherein
the first support plate further has welding ribs welded to the second other-side distal ends of the plural second blades, and
the welding ribs extend to the down-step portion, with a height of sections of the welding ribs positioned in the down-step portion being lower than a height of sections of the welding ribs on an inner peripheral side of the down-step portion.

20. A cross-flow fan that is made of resin, the cross-flow fan comprising:
a first fan block including
a disc-shaped or annular first support plate,
plural first blades having first one-side distal ends connected to the first support plate, and
a first outer peripheral ring having a first ring portion that interconnects outer ends of the plural first blades adjacent first other-side distal ends of the plural first blades located on an opposite side of the first one-side distal ends; and
a second fan block including
a disc-shaped or annular second support plate,
plural second blades having second one-side distal ends connected to the second support plate, and
a second outer peripheral ring having a second ring portion that interconnects outer ends of the plural second blades adjacent second other-side distal ends of the plural second blades located on an opposite side of the second one-side distal ends,
the first fan block and the second fan block being joined together,
the second other-side distal ends of the plural second blades being joined to the first support plate, and the first support plate and the second outer peripheral ring being disposed adjacent to each other, a gap being formed between the first support plate and the second outer peripheral ring, the gap being less than 1 mm, and
the second other-side distal ends of the plural second blades of the second fan block project toward the opposite side of the second one-side distal ends from the second outer peripheral ring.

21. The cross-flow fan according to claim 20, wherein
the first support plate has a down-step portion, and a section of the first support plate corresponding to the second outer peripheral ring is sunken below a section of the first support plate corresponding to an inner peripheral side of the second outer peripheral ring at the down-step portion,
the second outer peripheral ring enters the down-step portion, reducing a longitudinal direction thickness where the first support plate and the second outer peripheral ring lie on top of each other,
the first support plate further has welding ribs welded to the second other-side distal ends of the plural second blades, and
the welding ribs extend to the down-step portion, with a height of sections of the welding ribs positioned in the down-step portion being lower than a height of sections of the welding ribs on an inner peripheral side of the down-step portion.

22. The cross-flow fan according to claim 20, wherein the second outer peripheral ring has an outer radius equal to or smaller than an outer radius of the first support plate.

23. The cross-flow fan according to claim 20, wherein the second outer peripheral ring further has reinforcement ribs connected to negative pressure surfaces of the plural second blades but not connected to pressure surfaces of the plural second blades.

24. The cross-flow fan according to claim 20, wherein the second other-side distal ends of the plural second blades of the second fan block project toward the opposite side of the second one-side distal ends from the second outer peripheral ring, the first support plate has a down-step portion, and a section of the first support plate corresponding to the second outer peripheral ring is sunken below a section of the first support plate corresponding to an inner peripheral side of the second outer peripheral ring at the down-step portion, and the second outer peripheral ring enters the down-step portion, reducing a longitudinal direction thickness where the first support plate and the second outer peripheral ring lie on top of each other.

* * * * *